United States Patent [19]

Flanagan et al.

[11] 4,288,262

[45] Sep. 8, 1981

[54] GUN PROPELLANTS CONTAINING POLYGLYCIDYL AZIDE POLYMER

[75] Inventors: Joseph E. Flanagan, Woodland Hills; John C. Gray, Ventura, both of Calif.

[73] Assignee: Rockwell International Corporation, El Segundo, Calif.

[21] Appl. No.: 39,629

[22] Filed: May 7, 1979

Related U.S. Application Data

[63] Continuation-in-part of Ser. No. 891,581, Mar. 30, 1978, abandoned.

[51] Int. Cl.[3] ..... C06B 45/10

[52] U.S. Cl. ..... 149/19.6; 149/19.1; 149/19.8; 149/92

[58] Field of Search ..... 149/19.1, 19.6, 19.8, 149/92

[56] References Cited

U.S. PATENT DOCUMENTS

| | | | |
|---|---|---|---|
| 3,645,917 | 2/1972 | Vandenberg | 525/410 |
| 3,883,374 | 5/1975 | Rosher | 149/19.8 |
| 3,954,528 | 5/1976 | Chang et al. | 149/19.6 |
| 4,002,514 | 1/1977 | Plomer et al. | 149/19.8 |
| 4,085,123 | 4/1978 | Flanagan | 149/92 |

FOREIGN PATENT DOCUMENTS

| | | | |
|---|---|---|---|
| 1362506 | 8/1974 | United Kingdom | 149/19.8 |

*Primary Examiner*—Edward A. Miller

*Attorney, Agent, or Firm*—H. F. Hamann; Harry B. Field

[57] ABSTRACT

A family of gun propellants formulated with polyglycidyl azide polymer (GAP) in conjunction with nitrocellulose (NC) to provide reduced flame temperatures while providing high mass impetus.

9 Claims, No Drawings

GUN PROPELLANTS CONTAINING POLYGLYCIDYL AZIDE POLYMER

CROSS-REFERENCE TO RELATED APPLICATION

This application is a Continuation-In-Part of copending application Ser. No. 891,581, filed March 30, 1978, and now abandoned.

BACKGROUND OF THE INVENTION

1. Field of the Invention

This invention relates to propellants and is particularly directed to gun propellant formulations employing a copolymer of polyglycidyl azide (GAP) and nitrocellulose (NC) to provide low isochoric flame temperatures and high mass impetus.

2. Description of the Prior Art

Considerable advances have been realized in the area of improved gun propellants during the last ten years. The conventional gun propellants described in U.S. Army Propellant Manual No. AMCP-706-150, published February 1965, are based upon nitrocellulose, nitroglycerin (NG), and nitroguanidine (NQ).

Improvements in performance over those listed in Manual No. AMCP-706-150 have been made by incorporating triaminoguanidine nitrate (TAGN) and cyclotetramethylene tetranitramine (HMX) into the basic nitrocellulose matrix as described in U.S. Pat. Nos. 3,732,130; 3,732,131 and 3,909,323.

However, while the advanced propellants based upon TAGN/HMX/NC yield higher performance, these propellants generally contain more of the solid oxidizers (TAGN and HMX) on a weight basis than the binder (NC). This, in turn, can lead to erratic ballistics at extreme weather conditions where the propellant is subjected to very low temperatures (less than −25° F.). Due to the low level of polymer (binder) present, the propellant can become brittle and crack, thereby exposing larger areas for instantaneous burning. This results in overpressures in the gun breech.

In a similar manner, propellants which are to be inhibited according to U.S. Pat. No. 3,948,697 must rely on the residual hydroxyl groups in nitrocellulose for superior surface bonding. Incorporation of plasticizers which contain additional hydroxyl groups, such as polyethelene glycol, drastically lower the overall propellant performance since the heat of formation of the plasticizer is degraded by hydroxyl moieties.

SUMMARY OF THE INVENTION

Accordingly, there is provided by the present invention a family of propellants having low isochoric flame temperature and high mass impetus. These propellants basically comprise nitrocellulose and polyglycidyl azide. Additionally, they may be solids loaded with TAGN and/or HMX. Although primarily designed as a gun propellant, the addition of various propellant adjuvants will enhance the ballistic, chemical, and physical properties such that the propellant composition can be used in other pyrotechnic devices.

OBJECTS OF THE INVENTION

Accordingly, it is an object of the present invention to provide improved propellants.

Another object of the present invention is to provide improved gun propellants.

Yet another object of the present invention is to provide gun propellants having high mass impetus and superior properties at low ambient temperatures.

A specific object of the present invention is to provide gun propellant formulations employing GAP as a copolymer with NC.

DESCRIPTION OF THE PREFERRED EMBODIMENTS

In accordance with the present invention there is provided a propellant which comprises nitrocellulose (NC) and polyglycidyl azide (GAP). Basically, the polyglycidyl azide is used as an energetic binder and comprises a hydroxyterminated aliphatic polyether having pendent alkyl azide groups. The GAP energetic binder is more fully described in copending U.S. patent application Ser. No. 4,978, filed Jan. 8, 1979.

The NC/GAP propellant can be prepared having a ratio of ingredients ranging from one part NC to two parts GAP up to four parts NC to one part GAP. The preferred range would be from about 55 to about 85 weight percent NC and from about 45 to about 15 weight percent GAP. In addition, trace amounts up to about 0.5 weight percent of resorcinol stabilizer should be added.

The mass impetus of the NC/GAP based propellants can be increased by solids loading of the subject propellant. One such family of solids loaded propellants comprises from about 10 to about 40 weight percent NC, about 15 to about 30 weight percent GAP, from about 20 to about 70 weight percent HMX, and from about 0.2 to about 0.5 weight percent resorcinol.

Another family of solids loaded NC/GAP based propellants comprises from about 10 to about 40 weight percent NC, from about 15 to about 30 weight percent GAP, from about 20 to about 75 weight percent TAGN, from about 5 to about 55 weight percent HMX, and from about 0.2 to about 0.5 weight percent resorcinol.

A comparison of the NC/GAP propellant family with NC/NG and TAGN/HMX/NC propellants is given in Table I.

TABLE I

| Propellant | Type | Mass Impetus ft-lb/lb | Flame Temperature | Molecular Weight |
|---|---|---|---|---|
| Non-Solids | NC | 305,000 | 2417° K. | 22.06 |
| Loaded | NC | 339,000 | 3000° K. | 24.58 |
| | NC/GAP (1.5 to 1) | 327,000 | 2321° K. | 19.74 |
| | NC/GAP (4 to 1) | 342,000 | 2647° K. | 21.55 |
| Solids | NC/NG/NQ | 336,000 | 2594° K. | 21.53 |
| Loaded | NC/TAGN HMX | 352,000 | 2483° K. | 19.60 |
| | NC/GAP/ TAGN/HMX | 370,000 | 2595° K. | 19.51 |

By way of illustration and not limitation, the following examples are given:

EXAMPLE I

In accordance with the present invention, a gun propellant was formulated consisting of 60% by weight of NC, 40% by weight of GAP. This propellant yielded an isochoric flame temperature of 2321° K., a mass impetus of 327,000 ft-lbs/lb, and a molecular weight of 19.74.

EXAMPLE II

A gun propellant was formulated consisting of 80% by weight of NC, 20% by weight of GAP. This propellant yielded an isochoric flame temperature of 2647° K., a mass impetus of 342,000 ft-lbs/lb, and a molecular weight of 21.55.

EXAMPLE III

A gun propellant was formulated consisting of 38% by weight of NC, 20% by weight of GAP, 20% by weight of TAGN, and 22% by weight of HMX. This propellant yielded an isochoric flame temperature of 2483° K., a mass impetus of 352,000 ft-lbs/lb, and a molecular weight of 19.60.

Thus, it is apparent that there is provided by the present invention a nitrocellulose polyglycidyl azide based propellant.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. A propellant comprising nitrocellulose (NC) and polyglycidyl azide (GAP).

2. The propellant of claim 1 further comprising from about 0.2 to about 0.5 weight percent resorcinol stabilizers.

3. The propellant of claim 1 or 2 wherein said nitrocellulose and said polyglycidyl azide are combined in a ratio which ranges from about one part NC to about two parts GAP to from about four parts NC to about one part GAP.

4. The propellant of claim 3 wherein said NC ranges from about 55 to about 85 weight percent, said GAP ranges from about 45 to about 15 weight percent GAP.

5. The propellant of claim 3 which comprises about 60 weight percent NC and about 40 weight percent GAP.

6. The propellant of claim 3 which comprises about 80 weight percent NC and about 20 weight percent GAP.

7. The propellant of claims 1 or 2 which comprises from about 10 to about 40 weight percent NC, from about 15 to about 30 weight percent GAP, and from about 20 to about 70 weight percent cyclotetramethylene tetranitramine.

8. The propellant of claims 1 or 2 which comprises from about 10 to about 40 weight percent NC, from about 15 to about 30 weight percent GAP, from about 5 to about 35 weight percent cyclotetramethylene tetranitramine (HMX), and from about 20 to about 75 weight percent triaminoguanidine nitrate (TAGN).

9. The propellant of claim 8 which comprises about 38 weight percent NC, about 20 weight percent GAP, about 20 weight percent TAGN, and about 22 weight percent HMX.

* * * * *